United States Patent [19]

Masuda et al.

[11] 4,428,778

[45] Jan. 31, 1984

[54] PROCESS FOR PRODUCING METALLIC CHROMIUM PLATES AND SHEETS

[75] Inventors: Yoshimichi Masuda; Ryuzo Watanabe, both of Sendai; Shinichi Imura, Tokuyama; Kazutaka Sakiyama, Hofu, all of Japan

[73] Assignee: Toyo Soda Manufacturing Co., Ltd., Shinnanyo, Japan

[21] Appl. No.: 422,173

[22] Filed: Sep. 23, 1982

[30] Foreign Application Priority Data

Sep. 28, 1981 [JP] Japan ..... 56-152116

[51] Int. Cl.[3] ..... B22F 3/16

[52] U.S. Cl. ..... 148/11.5 P

[58] Field of Search ..... 148/11.5 P, 126

[56] References Cited

U.S. PATENT DOCUMENTS 1,760,367 5/1930 Marden et al. ..... 148/11.5 P

*Primary Examiner*—W. Stallard

*Attorney, Agent, or Firm*—Cushman, Darby & Cushman

[57] ABSTRACT

Disclosed is a process for producing metallic chromium sheets having satisfactory mechanical properties directly from metallic chromium powders by successive steps of rolling (or compacting), sintering, re-rolling and annealing.

4 Claims, No Drawings

PROCESS FOR PRODUCING METALLIC CHROMIUM PLATES AND SHEETS

BACKGROUND OF THE INVENTION

1. Field of the Invention

The present invention relates to a process for producing metallic chromium plates and sheets (hereinafter called "sheets") from metallic chromium powders, which process comprises rolling (or compacting) metallic chromium powders having −200 to −400 mesh particle size, sintering, re-rolling and annealing.

2. Description of the Prior Art

Conventionally, no trials or practices have been made for forming metallic chromium powders into shaped products such as sheets, because metallic chromium ingots are very brittle. However, metallic chromium has inherently very excellent properties, such as high strength at high temperatures, high resistance to various acids and high corrosion resistance, and is much less precious as compared with alloying elements, such as nickel and cobalt, which are added for desired heat resistance. Therefore, metallic chromium has very wide and extensive potential applications as alloying element for giving alloys heat resistance and corrosion resistance or as basic component of heat resistance or corrosion resistant alloys. On the other hand, metallic chromium has an inherent disadvantage that it is generally brittle and hence has great difficulty in performing plastic working so that the actual applications of metallic chromium have been largely limited. Therefore, strong demands have been being made for improving the brittleness and workability of metallic chromium.

Under the situation as mentioned above, if metallic chromium sheets can be efficiently and advantageously produced, various wide applications will be developed for such metallic chromium sheets due to their inherent excellent properties.

Various extensive studies and experiments have been made by the present inventors for improving the brittleness and poor workability peculiar to metallic chromium and have discovered a process for producing shaped products directly from metallic chromium powders, and the present invention has been completed on the basis of this discovery.

SUMMARY OF THE INVENTION

Therefore, one of the objects of the present invention is to provide a process which can easily produce metallic chromium sheets which have hitherto been practically impossible or very difficult.

The conventional metal powder rolling method is a special forming method for forming into sheet forms metal powders, such as aluminum, copper and nickel powders, which are easy to work into shapes, but it has been generally established that it is very difficult to produce shaped articles from brittle metal powders by the above conventional rolling method.

The present inventors have found that, despite the conventional knowledge, it is possible to produce metallic chromium sheets having satisfactory strength for practical purposes from metallic chromium powders, if the production is performed under special conditions.

DETAILED DESCRIPTION OF THE INVENTION

As the starting metallic chromium materials used in the present invention, conventionally available ordinary metallic chromium powders may be used.

However, it is preferable to use electrolytic chromium powders or vacuum-degassed high purity metallic chromium powders, having a predominant particle size ranging from −200 to −400 mesh, more desirably from −200 to −300 mesh.

The process according to the present invention comprises the following steps.

(1) Powder rolling (compacting) step

As the powder rolling method, conventional methods can be used. As the roll load, a load from 2 to 7 tons per $cm^2$ is required to obtain a rolled sheet of 0.3 mm in thickness from the metallic chromium powders by using, for example, two rolls of 150 mm in diameter and 40 mm in hopper width. The sheet products thus obtained have usually a tensile strength of 4 to 5 MPa (0.4 to 0.5 $kg/mm^2$).

(2) Sintering step

The sintering of the rolled (compacted) shapes obtained in the step (1) is performed at a temperature ranging from 900° to 1400° C., preferably from 1000° to 1200° C. for 30 minutes to 2 hours, in an ordinary electric furnace. Preferably inert gas, such as hydrogen, argon and helium, is used as a protective atmosphere for the sintering.

A sintering temperature below 900° C. is too low for assuring satisfactory sintering, but a sintering temperature above 1400° C. is detrimental because the sublimation of metallic chromium becomes remarkable. The sintering may be performed by a conventional induction heating method.

(3) Re-rolling step

The shaped, sintered products thus obtained is subjected to re-rolling which should be preferably done with 5 to 50% reduction, more preferably 10 to 40% using two rolls, for example. If the above rolling reduction of 5 to 50% is not achieved by a single step of rolling, the rolling is repeated until the desired reduction is achieved.

If the re-rolling reduction is less than 5%, no improvement on the tensile strength of the resultant products can be obtained, and on the other hand, a re-rolling reduction beyond 50% is not desirable due to remarkable tendencies of cracking in the resultant products.

(4) Annealing step

The re-rolled sheet products are reheated to preferably 500° to 1100° C. for 30 minutes to 2 hours to relieve the products of strains or to eliminate fine crackings in the products. As for the heating method, it may be done in an electric induction heating furnace, preferably under the presence of inert gas, such as hydrogen, argon and helium.

Annealing below 500° C. is not sufficient for achieving the desired results of the annealing, while annealing above 1100° C. is undesirable, because it will sometimes cause the recrystallization of the metal, hence deteriorating the material quality.

Satisfactory metallic chromium sheets can be obtained only when the above process steps are followed.

The metallic chromium sheets produced according to the present invention show good mechanical properties, with a maximum tensile strength as high as 320 MPa (3.2 kg/mm$^2$). Needless to say, the sheets can be worked into ribbons, chips, hollows (cylindrical articles), etc.

In this way, satisfactory production of metallic chromium sheets having good properties have been realized for the first time from metallic chromium powders under the specific production conditions as defined in the present invention.

DESCRIPTION OF PREFERRED EMBODIMENTS

The present invention will be better understood from the following description of preferred embodiments, but should not be limited thereto.

Electrolytic metallic chromium powders having a particle size of about −300 mesh are charged between rolls of 150 mm in diameter and 40 mm in hopper width (rotation rate: 5 rpm), under a load of about 3 tons/cm$^2$, to obtain rolled sheets of 0.3 mm in thickness. These rolled sheets are designated as A.

Degassed high purity metallic chromium powders having a particle size of about −200 mesh are rolled in a similar way as above with a roll load of 7 tons/cm$^2$ to obtain rolled sheets, designated as B.

Then these rolled sheets A and B are subjected to sintering, re-rolling and annealing under various conditions as shown below to obtain metallic chromium sheets having tensile strengths also shown below. The sintering and annealing steps are performed in an electric furnace in a hydrogen atmosphere.

| No. | Rolled Sheets | Sintering Temp. (°C.) | Time (hrs) | Re-rolling Reduction (%) | Annealing Temp. (°C.) | Time (hrs) | Tensile Strength of Resultant Metallic Chromium Sheets (MPa) |
|---|---|---|---|---|---|---|---|
| 1 | A | 900 | 0.5 | 40 | 1100 | 1.5 | 280 |
| 2 | " | 1100 | 1 | 30 | 800 | 2.0 | 330 |
| 3 | " | 1300 | 1 | 10 | 500 | 1 | 250 |
| 4 | B | 1000 | 1 | 40 | 1000 | 1 | 280 |
| 5 | " | 1100 | 1.5 | 20 | 900 | 1 | 250 |
| 6 | " | 1400 | 2.0 | 10 | 600 | 0.5 | 300 |

What we claim:

1. A process for producing metallic chromium sheets from metallic chromium powders, comprising:

(1) a step of rolling metallic chromium powders;

(2) a step of sintering rolled sheets thus obtained in a temperature range of from 900° to 1400° C.;

(3) a step of re-rolling the sintered sheets with a reduction ranging from 5 to 50%; and (4) a step of annealing the re-rolled sheets.

2. A process according to claim 1, in which the metallic chromium powders have a particle size ranging from −200 to −400 mesh.

3. A process according to claim 1, in which the rolling step (1) is performed with a load ranging from 2 to 7 tons/cm$^2$.

4. A process according to claim 1, in which the annealing is done in a temperature range of from 500 to 1100° C. for 30 minutes to 2 hours.

* * * * *